US009398677B2

(12) United States Patent
Tang et al.

(10) Patent No.: US 9,398,677 B2
(45) Date of Patent: Jul. 19, 2016

(54) CATHODE CONTROL MULTI-CATHODE DISTRIBUTED X-RAY APPARATUS AND CT DEVICE HAVING SAID APPARATUS

(71) Applicants: NUCTECH COMPANY LIMITED, Beijing (CN); TSINGHUA UNIVERSITY, Beijing (CN)

(72) Inventors: Huaping Tang, Beijing (CN); Chuanxiang Tang, Beijing (CN); Huaibi Chen, Bejing (CN)

(73) Assignees: NUCTECH COMPANY LIMITED, Beijing (CN); TSINGHUA UNIVERSITY, Beijing (CN)

( * ) Notice: Subject to any disclaimer, the term of this patent is extended or adjusted under 35 U.S.C. 154(b) by 266 days.

(21) Appl. No.: 14/135,035

(22) Filed: Dec. 19, 2013

(65) Prior Publication Data

US 2014/0185739 A1 Jul. 3, 2014

(30) Foreign Application Priority Data

Dec. 31, 2012 (CN) ..... 2012 1 0588832

(51) Int. Cl.

| | |
|---|---|
| ***H01J 35/06*** | (2006.01) |
| ***H05G 1/32*** | (2006.01) |
| *H05G 1/70* | (2006.01) |

(52) U.S. Cl.

CPC *H05G 1/32* (2013.01); *H01J 35/06* (2013.01); *H01J 2235/068* (2013.01); *H05G 1/70* (2013.01)

(58) Field of Classification Search

CPC ..... H01J 2235/068; H01J 35/06; H01J 35/14; H05G 1/52; H05G 1/70

USPC ..... 378/119, 121, 134

See application file for complete search history.

(56) References Cited

U.S. PATENT DOCUMENTS

| | | | | |
|---|---|---|---|---|
| 3,962,583 | A | 6/1976 | Holland | |
| 4,777,642 | A | 10/1988 | Ono | |
| 4,926,452 | A | 5/1990 | Baker | |
| 2006/0002514 | A1 | 1/2006 | Dunham | |
| 2011/0075802 | A1 | 3/2011 | Beckmann | |
| 2011/0255664 | A1* | 10/2011 | Ueda | H01J 35/065 378/62 |
| 2011/0286581 | A1* | 11/2011 | Sprenger | H01J 35/04 378/113 |

FOREIGN PATENT DOCUMENTS

| | | |
|---|---|---|
| CN | 101853762 | 10/2010 |
| CN | 203377194 | 1/2014 |
| WO | 2011/119629 | 9/2011 |

* cited by examiner

*Primary Examiner* — Courtney Thomas
(74) *Attorney, Agent, or Firm* — Casimir Jones, S.C.

(57) ABSTRACT

This invention relates to an apparatus producing distributed X-ray, and in particular to a cathode control multi-cathode distributed X-ray apparatus, which produces X-ray that changes focal position in a predetermined order by arranging multiple independent hot cathodes and controlling cathodes in an X-ray source device, and a CT device having said X-ray apparatus.

15 Claims, 3 Drawing Sheets

CATHODE CONTROL MULTI-CATHODE DISTRIBUTED X-RAY APPARATUS AND CT DEVICE HAVING SAID APPARATUS

CROSS-REFERENCE TO RELATED APPLICATION

The present application claims priority to pending Chinese Patent Application Nos. CN201210588832.0, filed Dec. 31, 2012, the contents of which are incorporated by reference in its entirety.

TECHNICAL FIELD

This invention relates to an apparatus producing distributed X-ray, and in particular to a cathode control multi-cathode distributed X-ray apparatus, which produces X-ray that changes focal position in a predetermined order by arranging multiple independent hot cathodes and controlling cathodes in an X-ray source device, and a CT device having said X-ray apparatus. The cathode control multi-cathode distributed X-ray apparatus of this invention comprises: a vacuum box with the perimeter sealed and a high vacuum inside; a plurality of cathodes independent of each other and arranged and mounted at one end inside the vacuum box; a plurality of focal current limiters arranged corresponding one by one to the cathodes and mounted at a position near the cathodes inside the vacuum box, the focal current limiters being connected to one another; an anode made of metal and mounted at another end inside the vacuum box, being parallel to the focal current limiters in the length direction and forming a predetermined included angle with the focal current limiters in the width direction; a power supply and control system, having a cathode power supply, a focal current limiter power supply connected to the focal current limiters, an anode high voltage power supply, and a control apparatus; a pluggable high voltage connector, for connecting the anode to the cable of the anode high voltage power supply, and mounted at the side face of one end of the vacuum box near the anode; a plurality of pluggable cathode power supply connectors, for connecting the cathode to the cathode power supply, and mounted at the side face of one end of the vacuum box near the cathode.

BACKGROUND ART

An X-ray source is a device that produces X-ray. It is composed generally of an X-ray tube, a power supply and control system, cooling and shielding and other accessories, with the X-ray tube being the core. The X-ray tube is usually composed of a cathode, an anode, a glass or ceramic housing. The cathode is a directly heated spiral tungsten filament which, when in operation, has current passes through and is heated up to the working temperature of about 2000K, thereby generating a thermally emitted electron beam stream. The cathode is surrounded by a metal cap that opens a slot in the front and enables electron focusing. The anode is a tungsten target inlaid at the end surface of a copper billet, and when in operation, a high voltage of hundreds of thousands of volts is applied between the anode and the cathode. The electrons generated by the cathode accelerate and fly to the anode under the action of the electric field, and hit the target surface, thereby producing X-ray.

X-ray is widely applied in such fields as industrial nondestructive examination, security check, medical diagnosis and treatment. In particular, the X-ray imaging device that makes use of the strong penetrating power of X-ray plays a vital role in every aspect of our daily life. At the early stage, said device was a planer X-ray imaging device of film, but now is the advanced digital 3D imaging device of high definition and multi-angle of view, e.g., computed tomography (CT), capable of acquiring 3D graphics or section images of high definition, being an advanced high-end application.

In a CT device (such as industrial defect detection CT, baggage inspection CT, medical diagnosis CT and so on), it is usual to put the X-ray source at one side of the object under inspection and a detector for receiving ray at the other side. When X-ray passes through an object, its strength varies with such information as the thickness and density of the object. The strength of X-ay received by the detector includes the structural information of one angle of view of the object under inspection. If the X-ray source and detector rotate around the object under inspection, we can acquire the structural information of different angle of view. Restructuring said information by a computer system and software algorithm can obtain a 3D image of the object under inspection. At present, the CT device is securing the X-ray source and detector to a circular slip ring surrounding the object under inspection. Every round of movement in work can get an image of a section of one thickness of the object under inspection, which is called a section. The object under inspection then moves along the direction of thickness to obtain a series of sections, which put together is just a fine 3D structure of the object under inspection. Therefore, for an existing CT device, in order to acquire information of different angle of view, it has to change the position of the X-ray source, so the X-ray source and detector need to move on the slip ring. To step up the inspection, the moving speed of the X-ray source and detector is often very fast. Due to the high speed movement on the slip ring, the overall reliability and stability of the device are reduced. Besides, as hindered by the moving speed, the CT inspection speed is also limited. Although the newest generation of CT in recent years mounts the detector in a circumferential manner such that the detector does not have to move, the X-ray source still has to move on the slip ring. Besides, multiple rows of detectors may be mounted so that a plurality of section images can be obtained every round the X-ray source moves, thereby increasing the CT inspection speed, but this does not solve the problem resulted from the movement on the slip ring fundamentally. Therefore, the CT device is need of an X-ray source capable of producing multiple angles of view without having to shift position.

Besides, in order to improve the inspection speed, it is usual that the electron beam produced by the cathode of the X-ray source has long and continuous high power bombardment on the anode tungsten target. However, because the target spot has a small area, the heat radiation of the target spot also becomes a big problem.

To solve the reliability and stability problem as well as the inspection speed problem and the anode target sport heat radiation problem brought about by the slip ring of the current CT device, existing patent documents propose some methods, such as rotary target X-ray source, which can solve the problem of overheating of the anode target to a certain extent, but its structure is complex and the target spot producing X-ray is still a definitive target spot position relative to the whole X-ray source. For example, in order to achieve multiple angles of view for a fixed X-ray source, some techniques arrange a plurality of independent traditional X-ray sources in a compact way on a circumference to displace the movement of the X-ray source. This may achieve multiple angles of view, but is too costly, and because the space between target spots of different angles of view is large, the image quality (3D resolution) is quite poor. In addition, the patent document 1 (U.S. Pat. No. 4,926,452) brings forward a light source and method for producing distributed X-ray, wherein the anode target has a very large area that alleviates the problem of the target overheating, and the target spot positions changing along the circumference can produce many angles of view. Although the patent document 1 is to scan and deflect the accelerated high energy electron beam, having the problem of being difficult to control, the locations of the target spots being not discrete and poorly repeatable, it is still an effective method capable of producing distributed light source. Moreover, the patent document 2 (US20110075802) and the patent document 3 (WO2011/119629) bring forward a light source and method for producing distributed X-ray, wherein the anode target has a very large area that alleviates the problem of the target overheating, and the target spots are scattered and fixed and arranged in an array, being able to produce many angles of view. Besides, carbon nano-tubes are used as the cold cathodes, the cold cathodes are arranged in an array, using the voltage between cathode grids to control field emission, thereby controlling every cathode to emit electrons in order, and bombard the target spots in a corresponding order of positions on the anode, thus becoming a distributed X-ray source. However, there are still such shortcomings as complex production process and insufficient capacity of emission and service life of carbon nano-tubes.

CONTENTS OF THE INVENTION

This invention is put forward to solve the above problems, aiming to provide a cathode control multi-cathode distributed X-ray apparatus that is capable of producing multiple angles of view without a mobile light source and is conducive to simplifying structure, improving system stability, reliability and increasing inspection efficiency.

This invention provides a cathode control multi-cathode distributed X-ray apparatus, characterised in that, comprising: a vacuum box with the perimeter sealed and a high vacuum inside; a plurality of cathodes independent of each other and arranged as a linear array and mounted at one end inside the vacuum box, each cathode having a cathode filament, a cathode surface connected to the cathode filament and a filament lead drawn out from both ends of the cathode filament; a plurality of focal current limiters arranged as a linear array corresponding one by one to the cathodes and mounted at a position near the cathodes in the middle part inside the vacuum box, the focal current limiters being connected to one another; an anode made of metal and mounted at another end inside the vacuum box, being parallel to the focal current limiters in the length direction and forming an included angle of predetermined degrees with the focal current limiters in the width direction; a power supply and control system, having a cathode power supply, a focal current limiter power supply connected to the interconnected focal current limiters, an anode high voltage power supply, and a control apparatus for exercising comprehensive logical control over the respective power supplies; a pluggable high voltage connector, for connecting the anode to the anode high voltage power supply, and installed at the side face of one end of the vacuum box near the anode; a plurality of pluggable cathode power supply connectors, for connecting the cathodes to the cathode power supply, and installed at the side face of one end of the vacuum box near the cathodes.

In the cathode control multi-cathode distributed X-ray apparatus provided by the present invention, the cathodes further comprise: a cathode housing, surrounding the cathode filament and the cathode surface, and a beam stream aperture being disposed at a position corresponding to the center of the cathode surface, a planar structure being disposed at the outer edge of the beam stream aperture, a slope being disposed at the outer edge of the planar structure; a cathode shield outside the cathode housing, surrounding other faces besides the one having a beam stream aperture of the cathode housing, the filament lead passes through the cathode housing and the cathode shield is drawn out to the pluggable cathode power supply connectors.

In the cathode control multi-cathode distributed X-ray apparatus provided by the present invention, the cathode housing and the cathode shield are in the shape of cuboids, while the cathode surface and the beam stream aperture corresponding to the center of the cathode surface are both rectangles.

In the cathode control multi-cathode distributed X-ray apparatus provided by the present invention, the cathode housing and the cathode shield are in the shape of cuboids, while the cathode surface and the beam stream aperture corresponding to the center of the cathode surface are circles.

In the cathode control multi-cathode distributed X-ray apparatus provided by the present invention, the cathode housing and the cathode shield are in the shape of cuboids, while the cathode surface is a spherical arc, the beam stream aperture corresponding to the center of the cathode surface is a circle.

In the cathode control multi-cathode distributed X-ray apparatus provided by the present invention, the vacuum box is made of glass or ceramic.

In the cathode control multi-cathode distributed X-ray apparatus provided by the present invention, the vacuum box is made of metal material, the inner wall of the vacuum box maintains an adequate insulating distance from the plurality of cathodes, the focal current limiter, and the anode.

In the cathode control multi-cathode distributed X-ray apparatus provided by the present invention, the inside of the pluggable high voltage connector is connected to the anode, the outside runs out from the vacuum box to closely connect to the wall of the vacuum box, together forming a vacuum sealing structure.

In the cathode control multi-cathode distributed X-ray apparatus provided by the present invention, each of the pluggable cathode power supply connectors is connected inside the vacuum box to the filament lead of the cathode, the outside runs out from the vacuum box to closely connect to the wall of the vacuum box, together forming a vacuum sealing structure.

The cathode control multi-cathode distributed X-ray apparatus provided by the present invention further comprises: a vacuum power supply included in the power supply and control system; a vacuum apparatus mounted on the side wall of the vacuum box, using the vacuum power supply to operate and maintain the high vacuum inside the vacuum box.

The cathode control multi-cathode distributed X-ray apparatus provided by the present invention further comprises: a shielding and collimator apparatus mounted outside the vacuum box, having a rectangular opening corresponding to the anode at the exit position of the X-ray that can be made use of.

In the cathode control multi-cathode distributed X-ray apparatus provided by the present invention, the shielding and collimator apparatus uses lead material.

In the cathode control multi-cathode distributed X-ray apparatus provided by the present invention, the focal current limiters comprise: an electric field isostatic surface made of metal and having a current limiting aperture in the center thereof; a focus electrode made of metal and in the shape of a cylinder, with its tip pointing right to the beam stream aperture of the cathode, the size of the current limiting aperture is less than or equal to the central aperture of the focus electrode.

In the cathode control multi-cathode distributed X-ray apparatus provided by the present invention, the plurality of cathodes are arranged as a straight line, and the plurality of focal current limiters are also arranged in a straight line accordingly.

In the cathode control multi-cathode distributed X-ray apparatus provided by the present invention, the plurality of cathodes are arranged as a circular arc, and the plurality of focal current limiters are also arranged as a circular arc corresponding to the plurality of cathodes, the anode is a conical arc, and accordingly the arrangement is in order of said cathodes, said focal current limiters and said anode, and the plane where the outer edge arc of the anode is located is a third plane parallel to the first plane where the plurality of cathodes are located and the second plane where the plurality of focal current limiters are located, the distance from the inner edge of the anode to the focal current limiters is farther than that from the outer edge of the anode to the focal current limiters.

The present invention provides a CT device, which comprises the cathode control multi-cathode distributed X-ray apparatus mentioned above.

The cathode control multi-cathode distributed X-ray apparatus of the present invention comprises a plurality of independent cathodes, a plurality of focal current limiters, an anode, a vacuum box, a pluggable high voltage connector, a plurality of pluggable cathode power supply connectors, and a power supply and control system, wherein the cathodes, focal current limiters and anode are mounted in the vacuum box, the high voltage connector and cathode power supply connectors are mounted on the wall of the vacuum box, forming an integral sealing structure together with the vacuum box. Under the heating action of the cathode filament, the cathodes generate electrons. In general, the focal current limiters have a negative voltage of hundred volts relative to the cathodes, limiting the electrons inside the cathodes. The control system, by preset control logic, enables the respective cathodes to give a negative high voltage pulse of kilovolts to each cathode in turn. The electrons in the cathodes that have received the negative high voltage pulse fly quickly to the focal current limiters, being focused into a small spot beam stream, passing through the current limiting aperture, entering the high voltage electric field acceleration region between the focal current limiters and the anode, receiving an electric field acceleration of dozens to hundreds of kilovolts, acquiring energy, and bombarding the anode in the end, thus generating X-ray. Because a plurality of independent cathode are arranged as an array, the generation position of electron beam stream and the X-ray generated by bombarding the anode are also arranged as an array accordingly.

In the cathode control multi-cathode distributed X-ray apparatus provided by the present invention, X-ray that changes focal positions periodically according to a certain order is generated in a light source device. The present invention adopts a thermal cathode source, which has such advantages over other designs as large emission current and long service life; a plurality of independent cathodes are arranged as a linear array, each of the cathodes are independent and they all use independent cathode power supply to control, thus being convenient and flexible; the focal current limiters corresponding to each cathode are arranged as a straight line and connected to each other, being in a stable small negative voltage potential, thus being easy to control; there is a certain distance between the cathode and the focal current limiters, thus being easy to process and produce; a design of rectangular large anode is adopted, thus effectively alleviating the problem of anode overheating, being conducive to improving the power of light source; the cathodes can be arranged in a straight line, wholly becoming a linear distributed X-ray apparatus; the cathodes can also be arranged in an arc, wholly becoming an arc-shaped distributed X-ray apparatus, being flexible in application. As compared with other distributed X-ray source device, the present invention has large current, small target spot, even target sport distribution, good repeatability, high output power, simple structure and convenient control.

Applying the distributed X-ray source of the present application to a CT device, there will be no need to move the light source to generate multiple angles of view, thus saving the slip ring movement, being conducive to simplifying structure, improving system stability, reliability and enhancing inspection efficiency.

EXPLANATIONS OF REFERENCE SIGNS

Figure 1:
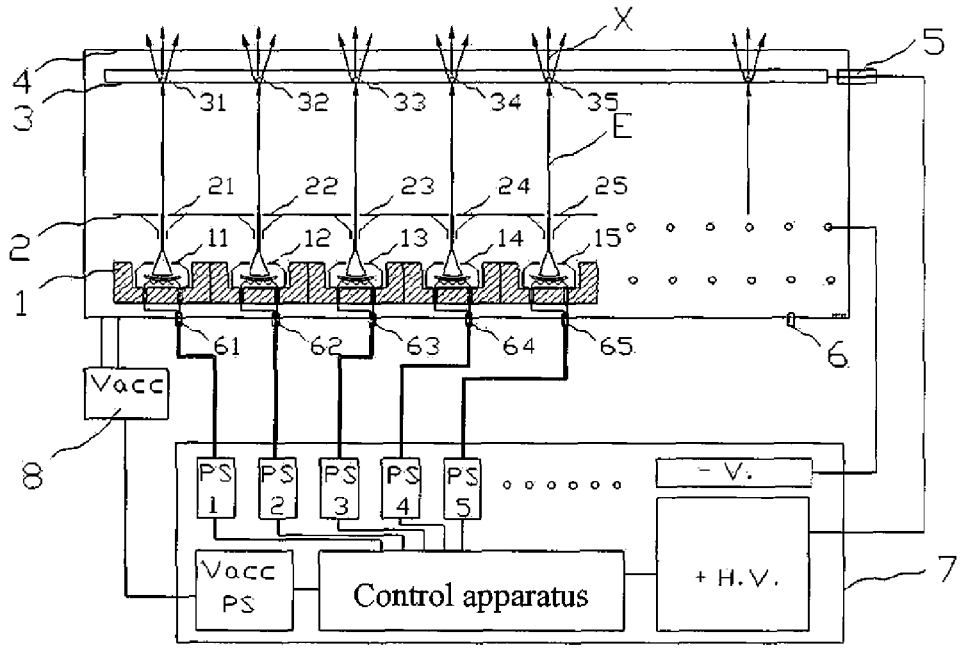
FIG. 1 is a schematic diagram of the cathode control multi-cathode distributed X-ray apparatus of the present invention.

1, 11, 12, 13, 14, 15 cathodes
2, 21, 22, 23, 24, 25 focal current limiters
3 anode
4 vacuum box
5 pluggable high voltage connector
6, 61, 62, 63, 64, 65 pluggable cathode power supply connectors
7 power supply and control system
8 vacuum box
9 shielding and collimator apparatus
E electron beam stream
X X-ray
C included angle formed by the anode and the focal current limiters

MODE OF CARRYING OUT THE INVENTION

Following are explanations of the present invention with reference to the figures.

FIG. 1 is a schematic diagram of the cathode control multi-cathode distributed X-ray apparatus of the present invention. As shown in FIG. 1, the cathode control multi-cathode distributed X-ray apparatus of the present invention has a plurality of cathodes 1 (at least two, hereinafter referred to also as cathodes 11, 12, 13, 14, 15 . . . ), a plurality of focal current limiters 2 corresponding to the plurality of cathodes 1 (hereinafter referred to also as focal current limiters 21, 22, 23, 24, 25 . . . ), an anode 3, a vacuum box 4, a pluggable high voltage connector 5, a plurality of pluggable cathode power supply connectors 6 and a power supply and control system 7.

A plurality of cathodes 1, a plurality of focal current limiters 2 and an anode 3 are mounted inside the vacuum box 4. The plurality of cathodes 1 are arranged in a straight line. The plurality of focal current limiters 2 each corresponds respectively to a cathode 1, and is also arranged as a straight line. The two straight lines are parallel to each other and are both parallel to the surface of the anode 3. The pluggable high voltage connector 5 and pluggable cathode power supply connectors 6 are mounted on the wall of the vacuum box 4, forming an integral sealing structure together with the vacuum box.

Figure 2:
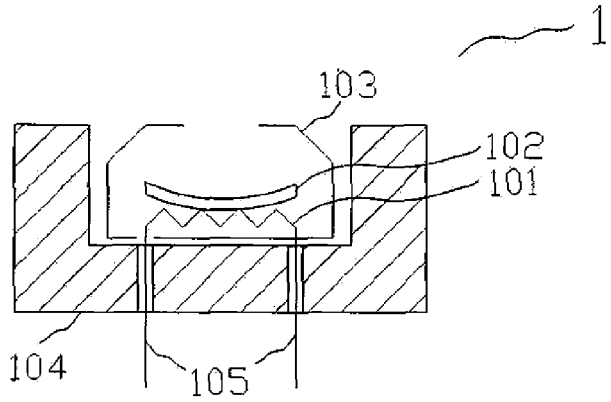
FIG. 2 is a schematic diagram of the structure of a type of independent cathode in the present invention.

Besides, the cathodes 1 are for generating electrons, being mounted on one side in the vacuum box 4 (defined here as the bottom end, see FIG. 1). In addition, FIG. 2 shows a structure of the cathodes 1, comprising: cathode filament 101; cathode surface 102; cathode housing 103; cathode shield 104; filament lead 105. As shown in FIG. 2, cathode surface 102 and cathode filament 101 are connected together, and they are surrounded by cathode housing 103, at the position of cathode housing 103 corresponding to the center of cathode surface 102 a beam stream aperture is disposed, faces other than the one having a beam stream aperture are surrounded by cathode shield 104 at the outside of cathode housing 103, filament lead 105 is drawn out from both ends of cathode filament 101 and passes through cathode housing 103 and cathode shield 104. Cathode filament 101 usually uses tungsten filament, cathode surface 102 often uses materials highly capable of thermal emission of electrons, being able to use barium oxide, scandate, $B_6La$ and so on. Cathode housing 103 is made of metallic material, being electrically connected to one end of cathode filament 101. A face having a beam stream aperture is disposed at cathode housing 103, a planer structure is disposed at the outer edge of the beam stream aperture, to facilitate concentration of electric fields at and around the beam stream aperture. There is a slope at the outer edge of the planer structure to facilitate smooth transition of electric fields between adjacent cathodes. Cathode shield 104 adopts insulating heat-resistant materials, being able to use, such as ceramics, for protection of cathode mechanical strength and insulation between adjacent cathodes. At the bottom of cathode shield 104 are two apertures for two filament leads 105 to pass, but the apertures for two filament leads 105 to pass are not limited to the bottom of cathode shield 104. As long as filament lead 105 can pass, any position will be fine. When cathodes at work, under the action of the cathode power supply, cathode filament 101 heats cathode surface 102 up to 1000-2000° C., cathode surface 102 generates an enormous amount of electrons. In general, the electric field at the beam stream aperture of cathode housing 103 is negative, electrons are confined inside cathode housing 103. If power supply and control system 7 causes cathode power supply to generate a negative high voltage pulse, which is usually 2 kV-10 kV, e.g., negative 5 kV, the electric field at the beam stream aperture becomes a positive electric field, electrons are emitted from the beam stream aperture to become an emission electron beam stream E, the density of the emitted current may reach several $A/cm^2$.

Figure 3:
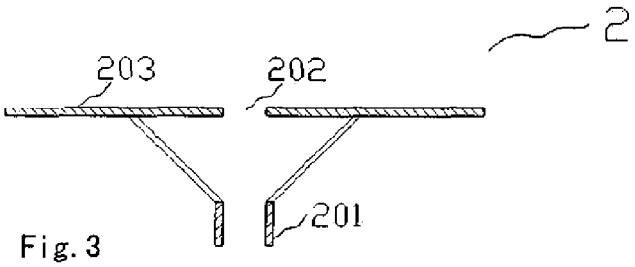
FIG. 3 is a schematic diagram of the structure of a type of focal current limiters in the present invention.

In addition, focal current limiters 2 are employed to focus the electron beam streams and limit its size, being installed inside vacuum box 4, near cathodes 1. FIG. 3 shows a structure of a single focal current limiter 2. Focal current limiter 2 is composed of a focus electrode 201, a current limiting aperture 202 and an electric field isostatic surface 203. Focal current limiter 2 is an all metal structure. Focus electrode 201 is made of metal and in the shape of a cylinder, with its tip pointing right at the beam stream aperture of the cathode. Electric fields converge to the tip of focus electrode 201 of focal current limiters 2 from the beam stream aperture and its surrounding planes at the upper surface of cathode housing 103, forming a focal electric field to have a focusing effect on the electron beam stream emitted from cathodes 1. Besides, electric field isostatic surface 203 is made of metal, with current limiting aperture 202 in its center. The size of current limiting aperture 202 is less than or equal to the central aperture of focus electrode 201. Electron beam stream enters current limiting aperture 202 through the central aperture of the focus electrode 201, having a temporary forward drifting movement, when reaching current limiting aperture 202, marginal and less forward electrons are blocked by the current limiting structure around current limiting aperture 202 (i.e., the part other than current limiting aperture 202 of electric field isostatic surface 203). Besides, only the electron beams that are pretty forward and concentrated at a small range pass through current limiting aperture 202 to enter the high voltage electric field between focal current limiters 2 and anode 3. Here, preferably the central axis of current limiting aperture 202 is identical with the central axis of focus electrode 201, thus being able to make the more forward electron beams to pass through current limiting aperture 202 to enter the high voltage electric field between focal current limiters 2 and anode 3. The electric field isostatic surface 203 of focal current limiters 2 opposite to anode 3 is a plane, being parallel in the length direction (i.e., the left-to-right direction in FIG. 1 and FIG. 3) to the plane of anode 3, so as to form between focal current limiters 2 and anode 3 a high voltage electric field whose power lines are parallel to each other and vertical to anode 3. To focal current limiters 2 a negative voltage −V is applied by the power supply of the focal current limiters, to form a reversed electric field (i.e., the electric field at the beam stream aperture is negative) at the beam stream aperture of cathode housing 103, thereby limiting the hot electrons of cathode surface 102 from flying out of cathode housing 103.

Besides, although the structure of focal current limiters 2 has been explained above, the structure of focal current limiters 2 is not limited thereto. It may be other structures as long as it can perform the function of focusing and current limiting. For example, the electric field isostatic surface 203 of a plurality of focal current limiters is integrally formed, and a current limiting aperture 202 is formed at every predetermined interval. This may reduce the process of manufacturing focal current limiters 2 and X-ray apparatus, thereby reducing the cost of manufacture.

Besides, cathodes 1 may be a structure of round inside and square outside, i.e., cathode housing 103 and cathode shield 104 are in the shape of cuboids, cathode surface 102 is circular, and the beam stream aperture at the upper surface of cathode housing 103 is circular. In order to make the electrons generated by cathode surface 102 achieve a better converging effect, it is usual to process cathode surface 102 into a spherical arc. The diameter of cathode surface 102 is usually several mm to 10 mm, e.g., the diameter being 4 mm. The diameter of the beam stream aperture of cathode housing 103 is usually several mm, e.g., the diameter being 2 mm. The focus electrode 201 corresponding to focal current limiter 2 is in the shape of a cylinder and the current limiting aperture 202 is also circular. In general, the diameter of focus electrode 201 is equivalent to the diameter of the beam stream aperture of cathode housing 103, e.g., the bore diameter of focus electrode 201 is 1.5 mm, the diameter of current limiting aperture 202 is 1 mm. the distance from the focus electrode 201 of focal current limiter 2 to current limiting aperture 202 is usually several mm, e.g., the distance being 4 mm.

Figure 4:
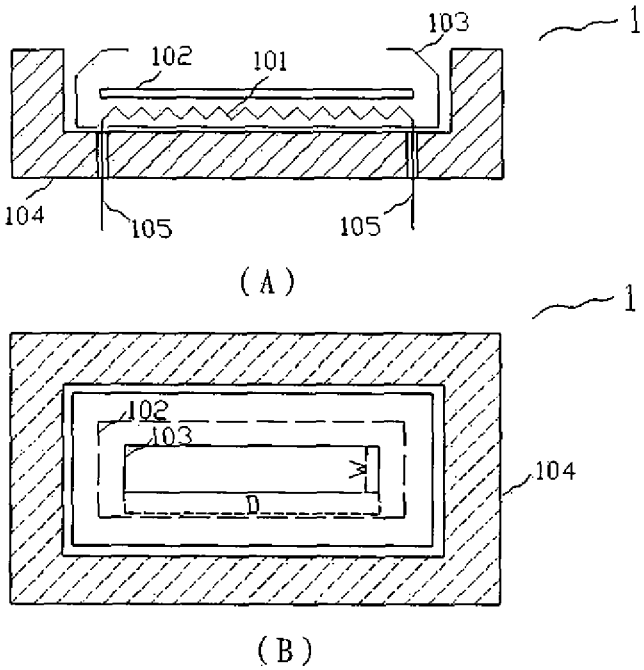
FIG. 4 is a schematic diagram of the structure of a type of rectangular cathodes in the present invention, (A) is the side view, (B) is a top view.

Furthermore, preferably, the cathodes are an inside and outside rectangular structure, i.e., the cathode housing 103 and cathode shield 104 are in the shape of cuboids, while the cathode surface 102 and the beam stream aperture corresponding to the center of the cathode surface 102 are both rectangles. The direction of linear arrangement of a plurality of cathodes 1 is the narrow side of a single cathode (width of a rectangle), the direction of arrangement perpendicular to cathodes 1 is the wide side (the length of the rectangle). FIG. 4 shows a structure of rectangular cathodes, (A) is the side view, (B) is a top view. Cathode surface 102 is a rectangle, preferably a cylindrical cambered surface, which is favorable for further converging the electron beam stream in the direction of the narrow side. In general, the cambered surface length is several mm to about a dozen mm, the width is several mm, e.g., the cambered surface length is 10 mm, width is 3 mm. As for the size of the beam stream aperture at the upper surface of cathode housing 103, the width W is preferably 2 mm, length D is preferably 8 mm. Besides, the corresponding focus electrode 201 of focal current limiters 2 is in the shape of a rectangular cylinder, the current limiting aperture 202 is a rectangle, and a plurality of focal current limiters 2 are arranged linearly corresponding to the arrangement of a plurality of cathodes 1, preferably the bore size of focus electrode 201 is 8 mm long and 1.5 mm wide, preferably the size of current limiting aperture 202 is 8 mm long and 1 mm wide. Preferably the distance from focus electrode 201 to current limiting aperture 202 is 4 mm.

Besides, anode 3 is rectangular metal, mounted at another end inside vacuum box 4 (defined here as the upper end, see FIG. 1), being parallel to focal current limiters 2 in the length direction and forming a small included angle with focal current limiters 2 in the width direction. Anode 3 is totally parallel to focal current limiters 2 in the length direction (see FIG. 1). A positive high voltage is applied on anode 3, which is usually dozens to hundreds of kV, typically 180 kV for example, thus forming parallel high voltage electric fields between anode 3 and focal current limiters 2. The electron beam stream that has passed through current limiting aperture 202 is accelerated by the high voltage electric field, moves long the field of the electric field and bombards anode 3 in the end, thereby generating X-ray. Besides, anode 3 uses heat-resistant material of the metal tungsten preferably.

Figure 5:
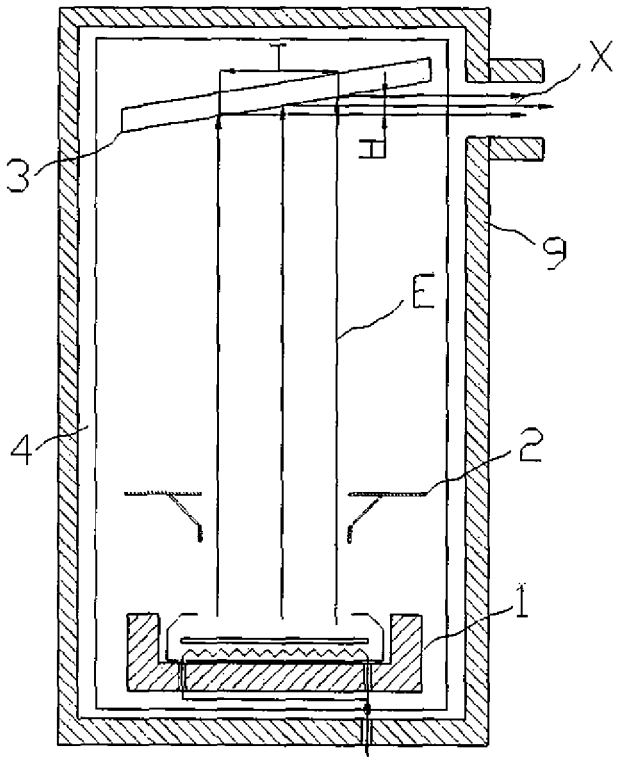
FIG. 5 is a schematic diagram of the structure of part of the side of the distributed X-ray apparatus adopting rectangular cathodes in the present invention.
Figure 6:
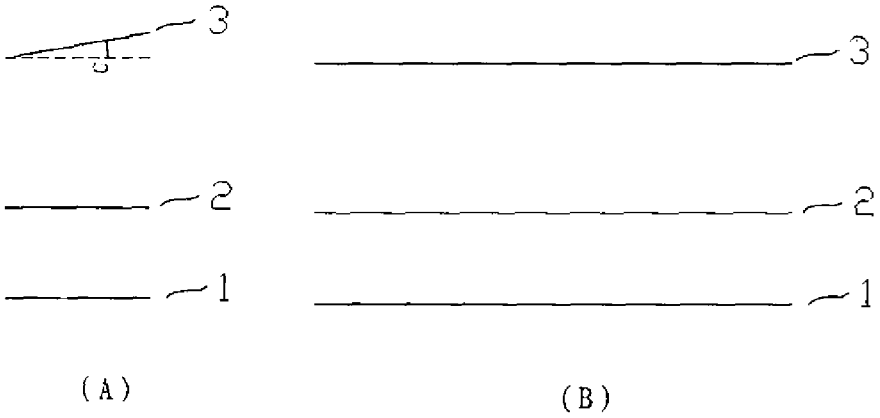
FIG. 6 is a schematic diagram of the relation of relative positions of the cathodes, focal current limiters and anode in the embodiments of the present invention.

FIG. 5 shows part of the side structure of the distributed X-ray apparatus adopting rectangular cathodes (here the left-to-right direction in the figure serves as the width direction, the direction perpendicular to the paper surface serves as the length direction, the length direction is also the direction of the linear arrangement of cathodes 1). FIG. 6 sketches out the relative position relations between cathodes 1, focal current limiters 2 and anode 3, wherein (A) represents the width direction, (B) represents the length direction. As shown by FIG. 5 and FIG. 6, the width direction of anode 3 forms a small included angle C with focal current limiters 2. The X-ray generated by the electron beam bombardment on anode 3 is the strongest in the direction that is 90 degrees to the incoming electron beam, so this direction becomes the ray utilization direction. Anode 3 tilts a predetermined small angle of C relative to focal current limiters 2, which is usually several or a dozen of degrees, thus being conducive to the outgoing of X-ray. On the other hand, wider electron beam stream (here the width of the electron beam stream is marked T), such as electron beam stream of T=8 mm, projects onto anode, but viewing from the outgoing direction of X-ray, the ray focus H generated thereby is smaller, e.g., H=1 mm, thus is equivalent to shrinking the focus size.

Besides, vacuum box 4 is a cavity housing sealed all around. Its inside is high vacuum. The housing is preferably insulating material, such as glass or ceramics and so on, but may also be stainless steel or other metallic material. The wall of vacuum box 4 keeps an adequate insulation space from cathodes 1, focal current limiters 2, and anode 3. Inside vacuum box 4, a plurality of cathodes 1 are mounted at its bottom end and arranged as a straight line. In the middle, near the array of cathodes 1, a plurality of focal current limiters 2 are mounted, each of focal current limiters 2 correspond to the position of cathodes 1, and also arranged as a straight line. Besides, the electric field isostatic surfaces 203 of adjacent focal current limiters 2 are connected to each other and form a plane on the upper end of which a rectangular anode 3 is mounted, and in the length direction, anode 3, focal current limiters 2 and cathodes 1 are parallel to each other. The inside space of vacuum box 4 is enough for the electron beams stream to move about in the electric field, without any blockage. The high vacuum in vacuum box 4 is acquired by baking and exhausting in a high temperature exhaust furnace, the vacuum degree is often better than $10^{-5}$ Pa.

Besides, pluggable high voltage connector 5 is to connect anode 3 to the cable of the high voltage power supply, being installed at the side face of one end of vacuum box 4 near anode 3. The inside of pluggable high voltage connector 5 is connected to anode 3, the outside runs out from the vacuum box 4 to closely connect to the wall of the vacuum box 4, together forming a vacuum sealing structure.

Pluggable cathode power supply connectors 6 (the pluggable cathode power supply connectors 61, 62, 63, 64, 65 . . . may be called by the joint name of pluggable cathode power supply connectors 6) are to connect cathodes 1 to the cathode power supply, being installed at the side face of one end of vacuum box 4 near cathodes 1. Pluggable cathode power supply connectors 6 have the same quantity and arrangement as cathodes 1. Each of pluggable cathode power supply connectors 6 is connected inside the vacuum box 4 to the filament lead 105 of cathodes 1, the outside runs out from the vacuum box 4 to closely connect to the wall of vacuum box 4, together forming a vacuum sealing structure.

Power supply and control system 7 provides the required power supply and operation control to the various components of the cathode control multi-cathode distributed X-ray apparatus. Power supply and control system 7 comprises: a plurality of cathode power supplies PS1, PS2, PS3, PS4, PS5, . . . for supplying power to cathodes 1; a focal current limiter power supply −V. for supplying power to focal current limiters 2; an anode high voltage power supply +H.V. for supplying power to anode 3; and a control apparatus and so on. The control apparatus exercises comprehensive logical control over the respective power supplies, thereby controlling the normal operation of the whole system, and being able to provide an external control interface and a human-machine operation interface. Typically, program settings and negative feedback automatic adjustments can be made for the cathode negative high voltage pulse size and output filament current size of each cathode power supply by controlling the system programs, such that after the electron beam stream generated by each cathode accelerates and hits the target, the strength of the X-ray produced is consistent. In addition, it is also possible to control the system programming to determine the work sequence of each cathode according to the order of the negative high voltage pulses outputted by the respective cathode power supplies, which may be single cathode wording in order (such as $1^{st}\rightarrow 2^{nd}\rightarrow 3^{rd}\rightarrow 4^{th}\rightarrow 5^{th}\rightarrow \ldots$), or a plurality of separated cathodes working in sequence (such as $(1^{st}, 5^{th}, 9^{th})\rightarrow(2^{nd}, 6^{th}, 10^{th})\rightarrow(3^{rd}, 7^{th}, 11^{th})\rightarrow \ldots$, or other types of program setting solutions. Besides, the number of cathode power supplies for supplying power to cathodes are plural in the above manner (i.e., a plurality of cathode power supplies PS1, PS2, PS3, PS4, PS5, . . . ), but it is also feasible to be one cathode circuit divided into multiple parts to supply power to the respective cathodes.

Furthermore, the cathode control multi-cathode distributed X-ray apparatus may further comprises a vacuum apparatus 8, which is mounted on the side wall of vacuum box 4 and operates under the action of the vacuum power supply for sustaining the high vacuum inside the vacuum box 4. In general, when the distributed X-ray apparatus is at work, the electron beam stream bombards anode 3, so anode 3 will give out heat and release a small amount of gas. In this invention, vacuum apparatus 8 can be employed to quickly draw out this part of gas to sustain the high vacuum degree inside the vacuum box 4. Besides, it is preferable that vacuum apparatus 8 uses a vacuum ion bump. Accordingly, the power supply and control system 7 of the cathode control multi-cathode distributed X-ray apparatus further comprises a power supply Vacc PS for supplying power to vacuum apparatus 8.

What's more, the cathode control multi-cathode distributed X-ray apparatus further comprises a shielding and collimator apparatus 9 mounted outside the vacuum box 4 for shielding unwanted X-ray, having a rectangular opening corresponding to anode 3 at the exit position of the X-ray that can be made use of. At the opening, along the X-ray outgoing direction, there is a part for confining X-ray to the scope of desired applications in the length direction, width direction and the up and down direction in FIG. 5 (see FIG. 5), and the shielding and collimator apparatus uses lead material.

Figure 7:
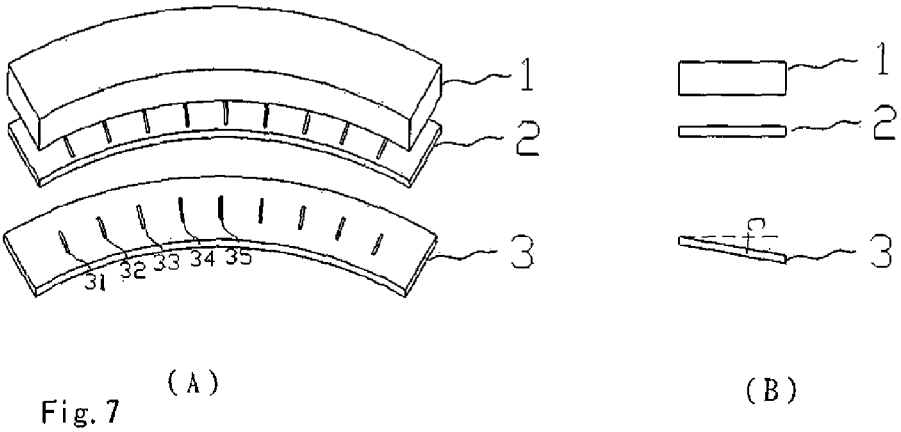
FIG. 7 is a schematic diagram of the structure of the distributed X-ray apparatus arranged in a circular arc in the present invention.

It should be pointed out in particular that in the above cathode control multi-cathode distributed X-ray apparatus, the plurality of cathodes 1 can be arranged in a straight line, but may also be arranged in a circular arc, thereby satisfying different application requirements. FIG. 7 is a schematic diagram of the structure of the circular arc type cathode control multi-cathode distributed X-ray apparatus, where (A) is a stereogram, (B) is an end view drawing. By the up to down sequence, a plurality of cathodes 1 are arranged as a circular arc in the first plane, and accordingly, a plurality of focal current limiters 2 are arranged as a circular arc in a second plane parallel to the first plane, and the respective focal current limiters 2 correspond one by one to the respective cathodes in the relations of upper and lower positions. Besides, the conical arc anode 3 is arranged below focal current limiters 2, being parallel to the first plane in the direct of arc, and forming a predetermined included angle C with the first plane in radial direction, the included angle C being several to a dozen of degrees in general, and the direction of dip is the anode inner edge tilts downwards (as shown by (B) of FIG. 7). In other words, the distance from the inner edge of anode 3 to focal current limiters 2 is farther than the distance from the outer edge of anode 3 to focal current limiters 2. Emitted from cathodes 1, electron beam stream is focused and limited by focal current limiters, then enters between the focal current limiters and the anode, where it is accelerated by high voltage electric field, bombards anode 3, forming on anode 3 a series of focuses 31, 32, 33, 34, 35 . . . arranged as a circular arc, the outgoing direction of available X-ray directs at the center of the circular arc. All outgoing X-ray of the circular arc type distributed X-ray apparatus points to the center of the circular arc, being applicable to situations that require the ray source to be arranged in circle.

(System Makeup)

As shown by FIG. 1 to FIG. 7, the cathode control multi-cathode distributed X-ray apparatus of the present invention has a plurality of cathodes, a plurality of focal current limiters 2, an anode 3, a vacuum box 4, a pluggable high voltage connector 5, a plurality of pluggable cathode power supply connectors 6 and a power supply and control system 7, and may further comprises a vacuum apparatus 8 and a shielding and collimator apparatus 9. The plurality of cathodes 1 are independent of each other. The plurality of focal current limiters 2 are mounted at a position in the middle of vacuum box 4 near cathodes 1, correspond one by one to cathodes 1, and also arranged as a linear array. All focal current limiters 2 are connected to one another. The rectangular anode 3 is mounted at the upper end in vacuum box 4. The array of cathodes 1, the array of focal current limiters 2 and anode 3 are parallel to each other. Pluggable high voltage connector 5 is mounted at the upper end of vacuum box 4, the inside of which is connected to anode 3 and the outside of which can be connected to a high voltage cable. A plurality of pluggable cathode power supply connectors 6 are mounted at the bottom end of vacuum box 4. The inside of the pluggable cathode power supply connectors 6 is connected to cathodes 1, while the outside being connected to each cathode power supply through a cable. Vacuum apparatus 8 is mounted at the side wall of vacuum box 4. Power supply and control system 7 comprises a plurality of cathode power supplies PS1, PS2, PS3, PS4, PS5, . . . , a focal current limiter power supply −V., a vacuum power supply Vacc PS, an anode high voltage power supply +H.V., a control apparatus and other modules, connecting respectively with a plurality of cathodes 1, a plurality of focal current limiters 2, vacuum apparatus 8, anode 3 and other parts through the power cable and control cable.

(Principle of Operation)

In the cathode control multi-cathode distributed X-ray apparatus, by the control of the power supply and the control system 7, the plurality of cathode power supplies PS1, PS2, PS3, PS4, PS5, . . . , focal current limiter power supply −V., vacuum power supply Vacc PS, anode high voltage power supply +H.V. and the like are made to work according to a preset program. The cathode power supply supplies power to cathode filament 101, which heats cathode surface 102 up to a very high temperature to generate a great amount of thermal emitting electrons. The focal current limiter power supply −V. applies a negative voltage of 200V to the interconnected focal current limiters 2, forming a reversed electric field at the beam stream aperture of each of cathodes 1, thereby limiting the hot electrons of cathode surface 102 from flying out of cathode housing 103. The anode high voltage power supply +H.V. provides a positive voltage of 160 kV to anode 3, forming a positive high voltage electric field between the array of focal current limiters 2 and anode 3. Time 1: power supply and control system 7 controls the cathode power supply PS1 to generate a negative high voltage pulse of 2 kV and supply to cathodes 11, the overall voltage of cathodes 11 has a pulse-like drop, such that the electric field between cathodes 11 and focal current limiters 21 becomes a positive electric field instantly, the thermal electrons in the cathode housing of cathodes 11 emits out from the beam stream aperture, flying to the focus electrode of focal current limiters 21. The thermal electrons, being focused during the movement, becomes a small size of electron beam stream, and most of which enters the central aperture of the focus electrode, and arrives at the current limiting aperture after a short period of drift motion. Marginal and less forward electrons are blocked by the current limiting structure around current limiting aperture. Only the electron beams that are consistently forward and concentrated at a small range pass through the current limiting aperture to enter the positive high voltage electric field and are accelerated to acquire energy, and in the end, bombard anode 3 to generate X-ray. The focal position of X-ray is a projection on anode 3 by the connecting line of cathode surface 102 of cathodes 11, focus electrode 201 of focal current limiters 21, and current limiting aperture 202, i.e., focus 31. Time 2: similar to time 1, power supply and control system 7 controls the cathode power supply PS2 to generate a negative high voltage pulse of 2 kV and supply to cathodes 12, the overall voltage of cathodes 12 has a pulse-like drop, such that the electric field between cathodes 12 and focal current limiters 22 becomes a positive electric field instantly, the thermal electrons in the cathode housing of cathodes 12 emits out from the beam stream aperture, flying to the focus electrode of focal current limiters 22. The thermal electrons, being focused during the movement, becomes a small size of electron beam stream, and most of which enters the central aperture of the focus electrode, and arrives at the current limiting aperture after a short period of drift motion. Marginal and less forward electrons are blocked by the current limiting structure around current limiting aperture. Only the electron beams that are consistently forward and concentrated at a small range pass through the current limiting aperture to enter the positive high voltage electric field and are accelerated to acquire energy, and in the end, bombard anode 3 to generate X-ray. The focal position of X-ray is a projection on anode 3 by the connecting line of cathode surface 102 of cathodes 12, focus electrode 201 of focal current limiters 22, and current limiting aperture 202, i.e., focus 32. Likewise, at time 3, cathodes 13 acquire a pulse negative high voltage, generate an electron beam, which is focused and limited by focal current limiters 23, enters a high voltage electric field to be accelerated, and bombards anode 3 to generate X-ray, the focal position is 33; at time 4, the focal position is 34; at time 5, the focal position is 35; . . . until the last cathode emits a beam stream and produces the last focal position, thus completing a work cycle. At the next cycle, repeat the focal positions 31, 32, 33, 34, . . . to generate X-ray.

The gas released by anode 3 when being bombarded by electron beam stream is drawn away in real time by vacuum apparatus 8, thus vacuum box maintains a high vacuum, which is conducive to long-time stable operation. Shielding and collimator apparatus 9 shields the X-ray in the unavailable direction, allows the X-ray in the available direction to pass, and confines the X-ray within a predetermined range. Power supply and control system 7, in addition to controlling the various power supplies by preset programs to drive the respective parts to coordinate operations, can also receive external commands through communication interface and man-machine interface to modify and set key parameters of the system to update program and perform automatic control adjustment.

Besides, the cathode control multi-cathode distributed X-ray apparatus of the present invention can be applied to CT devices, thus being able to obtain a CT device capable of producing a plurality of angles of view without having to move the X-ray apparatus.

(Effects)

This invention provides a cathode control multi-cathode distributed X-ray apparatus, which produces X-ray that changes focal position periodically in a predetermined order in a light source device. This invention adopts a hot cathode source, which has such advantages over other designs as large emission current and long service life; a plurality of independent cathodes are arranged as a linear array, each of the cathodes are independent and they all use independent cathode power supply to control, thus being convenient and flexible; the focal current limiters corresponding to each cathode are arranged as a straight line and connected to each other, being in a stable small negative voltage potential, thus being easy to control; there is a fairly large distance between the cathode and the focal current limiters, thus being easy to process and produce; a design of rectangular large anode is adopted, thus effectively alleviating the problem of anode overheating, being conducive to improving the power of light source; the cathodes can be arranged as a straight line, wholly becoming a linear distributed X-ray apparatus; the cathodes can also be arranged as an arc, wholly becoming an arc-shaped distributed X-ray apparatus, being flexible in application. As compared with other distributed X-ray source device, the present invention has large current, small target spot, even target sport distribution, good repeatability, high output power, simple structure and convenient control. Besides, applying the distributed X-ray source of the present invention to a CT device, there will be no need to move the light source to generate multiple angles of view, thus saving the slip ring movement, being conducive to simplifying structure, improving system stability, reliability and enhancing inspection efficiency.

As stated above, the present invention is explained, but it does not end here. We should understand that any modifications can be made within the scope of spirits of the present invention. For example, the anode is not limited to the one used in the above embodiments. Any anode will do so long as it can form a plurality of target spots and is good at heat radiation. Besides, the cathodes are also not limited to those used in the embodiments above, and any cathode will do so long as it can emit X-ray.

The invention claimed is:

1. A cathode control multi-cathode distributed X-ray apparatus, characterised in that, comprising:

a vacuum box with the perimeter sealed and a high vacuum inside;

a plurality of cathodes independent of each other and arranged as a linear array and mounted at one end inside the vacuum box, each cathode having a cathode filament, a cathode surface connected to the cathode filament and a filament lead drawn out from both ends of the cathode filament;

a plurality of focal current limiters arranged as a linear array corresponding one by one to the cathodes and mounted at a position near the cathodes in the middle part inside the vacuum box, the focal current limiters being connected to one another;

an anode made of metal and mounted at another end inside the vacuum box, being parallel to the focal current limiters in the length direction and forming an included angle of predetermined degrees with the focal current limiters in the width direction;

a power supply and control system, having a cathode power supply, a focal current limiter power supply connected to the interconnected focal current limiters, an anode high voltage power supply, and a control apparatus for exercising comprehensive logical control over the respective power supplies;

a pluggable high voltage connector, for connecting the anode to the anode high voltage power supply, and installed at the side face of one end of the vacuum box near the anode; and a plurality of pluggable cathode power supply connectors, for connecting the cathode to the cathode power supply, and installed at the side face of one end of the vacuum box near the cathode, wherein the focal current limiters comprise: an electric field isostatic surface made of metal and having a current limiting aperture in the center thereof; a focus electrode made of metal and in the shape of a cylinder, with its tip pointing right to a beam stream aperture of the cathode, the size of the current limiting aperture is less than or equal to a central aperture of the focus electrode.

2. The cathode control multi-cathode distributed X-ray apparatus according to claim 1, characterised in that:

the cathodes further comprise: a cathode housing, surrounding the cathode filament and the cathode surface, and a beam stream aperture being disposed at a position corresponding to the center of the cathode surface, a planar structure being disposed at the outer edge of the beam stream aperture, a slope being disposed at the outer edge of the planar structure; a cathode shield outside the cathode housing, surrounding other faces besides the one having a beam stream aperture of the cathode housing, the filament lead passes through the cathode housing and the cathode shield is drawn out to the pluggable cathode power supply connectors.

3. The cathode control multi-cathode distributed X-ray apparatus according to claim 2, characterised in that:

the cathode housing and the cathode shield are in the shape of cuboids, while the cathode surface and the beam stream aperture corresponding to the center of the cathode surface are both rectangles.

4. The cathode control multi-cathode distributed X-ray apparatus according to claim 2, characterised in that:

the cathode housing and the cathode shield are in the shape of cuboids, while the cathode surface and the beam stream aperture corresponding to the center of the cathode surface are circles.

5. The cathode control multi-cathode distributed X-ray apparatus according to claim 2, characterised in that:

the cathode housing and the cathode shield are in the shape of cuboids, while the cathode surface is a spherical arc, the beam stream aperture corresponding to the center of the cathode surface is a circle.

6. The cathode control multi-cathode distributed X-ray apparatus according to claim 1, characterised in that:

the vacuum box is made of glass or ceramic.

7. The cathode control multi-cathode distributed X-ray apparatus according to claim 1, characterised in that:

the vacuum box is made of metal material.

8. The cathode control multi-cathode distributed X-ray apparatus according to claim 1, characterised in that:

the inside of the pluggable high voltage connector is connected to the anode, the outside runs out from the vacuum box to closely connect to the wall of the vacuum box, together forming a vacuum sealing structure.

9. The cathode control multi-cathode distributed X-ray apparatus according to claim 1, characterised in that:

each of the pluggable cathode power supply connectors is connected inside the vacuum box to the filament lead of the cathode, the outside runs out from the vacuum box to closely connect to the wall of the vacuum box, together forming a vacuum sealing structure.

10. The cathode control multi-cathode distributed X-ray apparatus according to claim 1, characterised in that:

further comprising: a vacuum power supply included in the power supply and control system; a vacuum apparatus mounted on the side wall of the vacuum box, using the vacuum power supply to operate and maintain the high vacuum inside the vacuum box.

11. The cathode control multi-cathode distributed X-ray apparatus according to claim 1, characterised in that:

further comprising: a shielding and collimator apparatus mounted outside the vacuum box, having a rectangular opening corresponding to the anode at the exit position of a wanted X-ray.

12. The cathode control multi-cathode distributed X-ray apparatus according to claim 11, characterised in that:

the shielding and collimator apparatus uses lead material.

13. The cathode control multi-cathode distributed X-ray apparatus according to claim 1, characterised in that:

the plurality of cathodes are arranged as a straight line, and the plurality of focal current limiters are also arranged in a straight line accordingly.

14. The cathode control multi-cathode distributed X-ray apparatus according to claim 1, characterised in that:

the plurality of cathodes are arranged as a circular arc, and the plurality of focal current limiters are also arranged as a circular arc corresponding to the plurality of cathodes, the anode is a conical arc, and accordingly the arrangement is in order of said cathodes, said focal current limiters and said anode, and the plane where the outer edge arc of the anode is located is a third plane parallel to the first plane where the plurality of cathodes are located and the second plane where the plurality of focal current limiters are located, the distance from the inner edge of the anode to the focal current limiters is farther than that from the outer edge of the anode to the focal current limiters.

15. A CT device comprising the cathode control multi-cathode distributed X-ray apparatus according to claim 1.

* * * * *